US005085253A

United States Patent [19]

Motta

[11] Patent Number: 5,085,253

[45] Date of Patent: Feb. 4, 1992

[54] LENO WEAVING WITH STATIONARY WARP THREADS AND SHIFTING CROSS THREADS

[76] Inventor: Carmelo Motta, Via F.lli Baracca, 22 Monza (Milan), Italy

[21] Appl. No.: 433,791

[22] Filed: Nov. 9, 1989

[30] Foreign Application Priority Data

Nov. 15, 1988 [IT] Italy ..... 22624 A/88

[51] Int. Cl.[5] ..... D03C 7/00

[52] U.S. Cl. ..... 139/50; 139/46; 139/51; 139/419

[58] Field of Search ..... 139/50, 51, 46, 419

[56] References Cited

U.S. PATENT DOCUMENTS

| | | | |
|---|---|---|---|
| 2,187,540 | 1/1940 | Egli | 139/51 |
| 2,278,862 | 4/1942 | Caron | 139/51 |
| 2,389,258 | 11/1945 | Hilton | 139/50 |
| 2,647,541 | 8/1953 | Nichols | 139/50 |
| 4,706,715 | 11/1987 | Murasaki | 139/46 |
| 4,862,925 | 9/1989 | Motta | 139/50 |

*Primary Examiner*—Andrew M. Falik
*Attorney, Agent, or Firm*—Charles A. Brown

[57] ABSTRACT

A leno or cross weaving texture is produced with a stationary warp thread and a cross warp thread which is alternately shifted from one side to the other of the stationary warp thread. The method of producing the leno weave includes the steps of providing a line segment of the stationary warp thread which connects first and second planes provided on the respective sides of the stationary warp thread, inclining the line segment of the stationary warp thread so as to cross a weaving plane alternately from an upper side of the first plane to an under side of the second plane, and from an under side of the first plane to an upper side of the second plane, and moving the cross warp thread in a perpendicular direction relative to the weaving plane and above the inclined line segment so that the cross warp thread is caused, during its movement, to slide along the inclined line segment towards the first plane or the second, thus producing the leno weave.

5 Claims, 10 Drawing Sheets

LENO WEAVING WITH STATIONARY WARP THREADS AND SHIFTING CROSS THREADS

Figure 1:
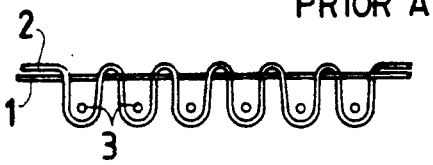
Fig.1 PRIOR ART

The present invention relates to a method for producing a leno or cross weaving texture.

In "gauze-weaving", a weaving method is defined in which a warp thread gets crossed with another warp thread, on the one side and on the other one side, i.e., "before and behind", relatively to another warp thread in order to obtain the gauze effect. The two warp threads are respectively denominated: the first one of them being the "crossing-thread", and second one being the "stationary-thread". These names are due not so much to the function, or to the arrangement of the threads in the obtained fabric or in which they are difficult to distinguish from each other, or in that they are pairs of mutually crossing threads, but the terms are useful in order to clarify the idea of the movement the threads make during the weaving. In other words, the terms express the concept that the "crossing-thread" is shifted to the one and to the other side of the "stationary-thread". The stationery-thread can also move, but in a direction substantially perpendicular to the weaving plane, and not parallel to it.

Various methods for producing the above the textile interlacement are known. Some methods belonging to a first type which takes advantage of the successive and alternate tensioning and releasing of two warp threads moving to both sides of another warp thread—called "stationary-thread"—, and slidingly connected with each other, so as to cause the crossing-thread(s) to shift to the one or to the other sides of the stationary-thread, whereby the desired textile effect of crossing of the crossing-thread(s) with the stationary-thread is consequently achieved. This type of method is shown in U.S. Pat. No. 4,862,925, issued to Carmelo Motta. In the U.S. Pat. No. 4,862,925, an auxiliary thread 15 is employed, in addition to a straight thread 13 and a twist thread 14, to form a leno weave. By contrast, the present invention does not require such an auxiliary thread 15, and the crossing thread of the present invention can be shifted alternately to either side of the stationary thread 7 merely by raising and lowering the crossing thread 7 and the stationary thread 4, as will be hereinafter explained.

A method of a second type exploits, on the contrary, the combined action of a set of special heddles—called "English leno or crossing weaving units"—in order to obtain the successive crossing of the stationary-thread and of the crossing-thread for generating the leno or cross weaving texture.

The first type of method enables high speeds to be rendered. It is possible by using the modern needle weaving planes (more than 2,000 weft insertions per minute) to fully exploit and mandatorily require mechanisms which make it possible for some warp threads to be successively tensioned and released. The warp threads undergo stretching, and render more complex the initial threading of the threads through the same weaving plane.

The use of the special "English-crossing" units, on the contrary, strongly limits the speed of the modern weaving planes, causing the speed to be decreased down to less than a half of its maximum available value and, owing to the thickness of the healds used, makes it necessary for particularly strong and valuable threads to be used, with a considerable increase in raw material costs.

The purpose of the method according to the present invention is of providing a solution for overcoming the limitations associated with the above methods known from the prior art. Thus it is possible for the actual capabilities of the modern weaving planes to be fully taken advantage of, while simultaneously simplifying their threading system and offering a high flexibility of realization.

A leno weave is one in which a pair of warp threads are twisted and woven into fabric.

This purpose, according to the present invention, is achieved by means of a method for producing a leno or cross weaving texture in which, alternatingly with successive weft insertions, a first warp thread gets crossed with at least one second warp thread, on the one side and on the other one side relatively to the at least one second warp thread, with the first warp thread, also said "crossing-thread", being provided with both transversal and perpendicular movement to the weaving plane, and the at least one second warp thread, also the "stationary-thread", being provided with only perpendicular movement to the weaving plane, the method being characterized in that it comprises the inventive steps of:

providing a line segment connecting, upstream a beating reed, two planes perpendicular to the weaving plane and laying: the one plane, on one side of the stationary thread, and the other one plane on the other side of the at least one stationary thread, with both of the planes being parallel to the at least one stationary thread, inclining the line segment so as to cause the line segment to cross the weaving plane alternatively on the one half-plane and on the other half-plane as defined by the at least one stationary thread, moving the crossing-thread in a vertical direction relatively to the weaving plane and above the line segment which is being inclined, so that the crossing-thread, by coming to rest against the inclined line segment at least when the inclined line segment crosses the weaving plane on one of the two half-planes into which the weaving plane is subdivided by the stationary-thread, is caused to slide towards this same half-plane, so as to cross the stationary-thread, thus producing the leno or cross weaving texture. By these aforementioned inventive steps, the present method for producing a leno or cross-weaving texture distinguishes over the aforementioned first and second types of methods.

The line segment can be composed by a plurality of segments, and e.g., any portions or set of portions of at least one thread constituted by either natural or artificial fibres, of plastic thread or of metal thread can be taken into consideration, which is destined to become a part of the fabric which is being formed, and is used for this specific function of realizing the shift of the crossing-thread from either side to the other side of the stationary-thread(s), by being moved in a per se known way, by connecting, e.g., two heals situated on opposite sides relatively to said stationary-thread(s).

The thread(s) which constitute(s) the line segment can then, one of them, a portion of them, or all of them, perform the function of stationary-threads in the end fabric, or can make a part as well of that portion of the fabric which is not a part of the gauze interlacement. In some forms of practical embodiments of the method according to the present invention, one, a portion of, or all of, the further at least one warp thread(s) which constitute(s) the line segment in question can remain inside the fabric only along a short distance downstream the point wherein the fabric is formed. Here the fabric gets disengaged from the warp thread(s) during and as a result of the movement of production progressing.

The line segment could also be at least a length of at least one thread which just connects organs, such as, e.g., two normal healds, which are shifted by inclining it according to the desired sequential cycles and in the proper directions.

According to a preferred form of practical embodiment of the production method according to the present invention, a normal weaving plane is used, which is previously provided, according to known techniques, with more or less advanced devices for moving, according to desired and presettable sequential cycles, the healds of the warp threads for the purpose of forming the shed through which other devices, also known from the prior art, subsequently insert the weft thread.

The method according to the present invention is disclosed in greater detail in the following by referring to the hereto attached drawings which illustrate, for merely exemplifying and non-limitative purposes and in a schematic way, some interlacings which can be accomplished by means of the teachings and the practicing of the above the method.

Figure 3:
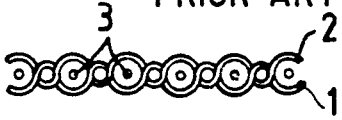
Fig.3 PRIOR ART
Figure 2:
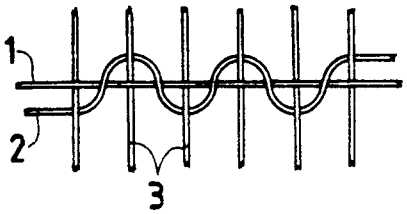
Fig.2 PRIOR ART
Figure 4:
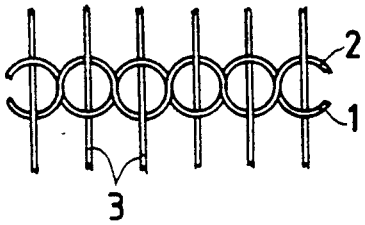
Fig.4 PRIOR ART
Figure 17:
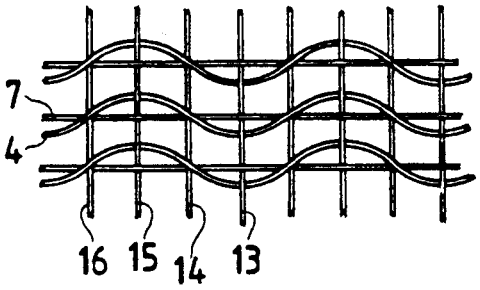
Figure 22:
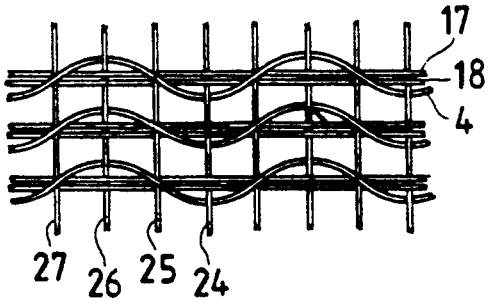
Figure 27:
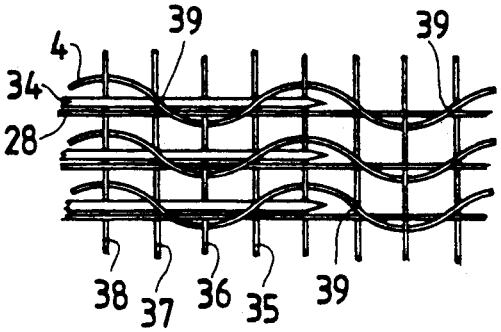
Figure 32:
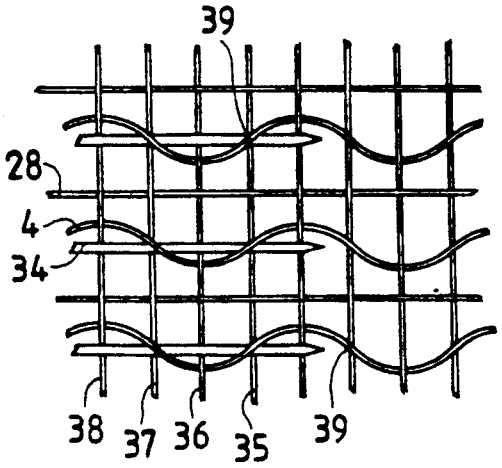

FIGS. 1 and 2 show a theoretical graphic representation of respectively the warp profile and the textile pattern relevant to two threads which generate a leno or cross weaving texture of the simplest and most classic type, in which the stationary-thread is not tied with the weft insertions, FIGS. 3 and 4 are are, on the contrary, a pictorial representation of the actual mutual relationship in which the two gauze-woven threads are arranged, respectively according to the warp profile and the textile pattern, FIGS. 5, 7, 9, 11, 13 and 15 show a process according to the present invention for obtaining a leno or cross weaving texture between a crossing-thread and a stationary-thread, using the same stationary-thread in order to accomplish the inclined line segment, FIGS. 6, 8, 10, 12, 14 and 16 show plan views of the arrangement of the healds and of the threads during the various steps of the process respectively depicted in the above FIGS. from 5 to 13, FIG. 17 shows a plan view of the textile interlacement which can be accomplished by means of the process shown in FIGS. from 5 to 16, FIGS. 18, 19, 20 and 21 show another exemplifying form of practical embodiment of the process according to the present invention in order to obtain a leno or cross weaving texture between one crossing-thread and two stationary-threads, wherein both of the stationary-threads realize the inclined line segment, FIGS. 18*a*, 19*a*, 20*a* and 21*a* are plan views of the arrangement of the healds and of the threads in the various steps of the process as respectively depicted in the preceding FIGS. from 18 to 21, FIG. 22 shows a plan view of the textile interlacement which can be accomplished by means of the process shown in FIGS. from 18 to 21, FIGS. 23, 24, 25 and 26 show how it is possible to produce, according to the present invention, a fabric having loops protruding outwards from its surface (of the same type as of the fabric useable for contact-fastenings of the so-called "hook and loop" type), using, for the inclined line segment, a stationary-thread which remains inside the same loops, FIGS. 23*a*, 24*a*, 25*a* and 26*a* show plan views of the arrangement of the healds and of the threads in the various steps of the process respectively depicted in the preceding FIGS. from 23 to 26, FIG. 27 shows a plan view of the textile interlacement which can be accomplished by means of the process shown in FIGS. from 23 to 26, FIGS. 28, 29, 30 and 31 show a further example of how by means of the method according to the present invention a fabric can be to accomplished, which is provided with loops protruding from its surface, but in this case, in order to define the inclined line segment, a warp thread being used, which will not become a part of the end leno or cross weaving texture, but will become a part of the base fabric, FIGS. 28*a*, 29*a*, 30*a* and 31*a* show plan views of the arrangement of the healds and of the threads during the various steps of the process respectively shown in the preceding FIGS. from 28 to 31, FIG. 32 shows a plan view of the textile interlacement which can be produced by means of the process shown in FIGS. from 28 to 31.

Reference is made to FIGS. 1 and 2 in order to show the theoretical mutual arrangement of the threads in case of a classic leno or cross weaving texture in which a thread 2, denominated "crossing-thread" gets crossed with a thread 1, denominated "stationary-thread".

FIG. 1, relevant to the warp profile, shows the non-essential feature of the stationary-thread remaining always on one side relatively to the weft, indicated by the reference numeral 3 in its various insertions, around which, on the contrary, the crossing-thread or wire 2 gets interlaced.

The textile pattern shown in FIG. 2 makes it possible for the feature—essential for the gauze interlacement—to be seen, of the crossing-wire 2 getting crossed with the stationary-thread 1, by being alternatively shifted, according to predetermined sequences, to the one and to the other side of the same stationary thread. The action of this crossing, as one will easily understand, fixes both of these threads in the fabric much better than the same threads would do by getting tied with the weft insertions, while remaining parallel to each other. It is precisely this feature which characterizes the so-called "leno or cross weaving texture". In fact, the same word "leno" means "light open texture fabric", i.e. a fabric in which groups of two warp threads are evenly spaced apart from each other by a few millimeters. In the case they were not suitably fixed by means of the interlacement of the weft insertions, would slide along these latter, in such a way as to eliminate the desired textile effect.

FIGS. 3 and 4 show how the stationary-thread 1 and the crossing-thread 2 get arranged in practice owing to the effects of the tensions and of the natural flexibility of the threads which constitute the textile interlacement. From these figures, one will easily see that the definition of "crossing-thread" and "stationary-thread" loses its meaning once both of the threads have been incorporated into the fabric. In the finished fabric the threads cannot be distinguished from each other.

Figure 5:
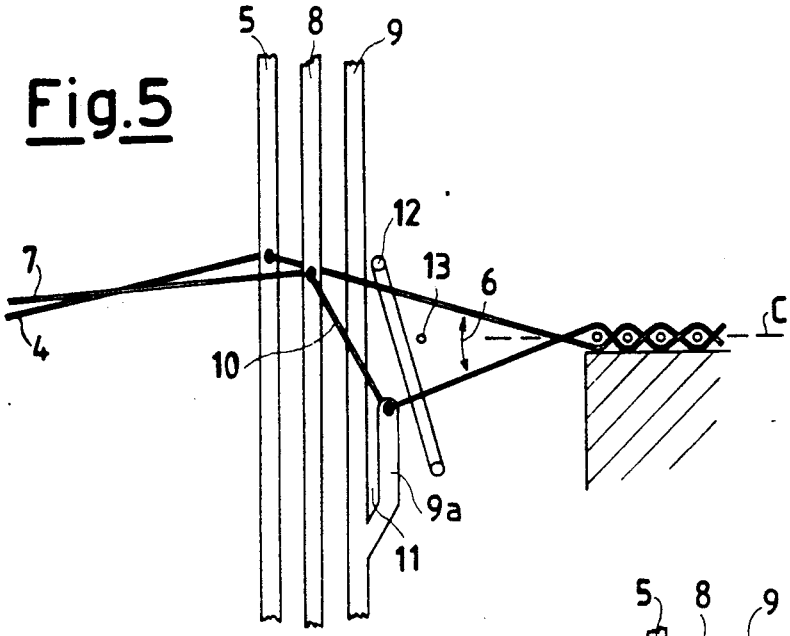
Figure 6:
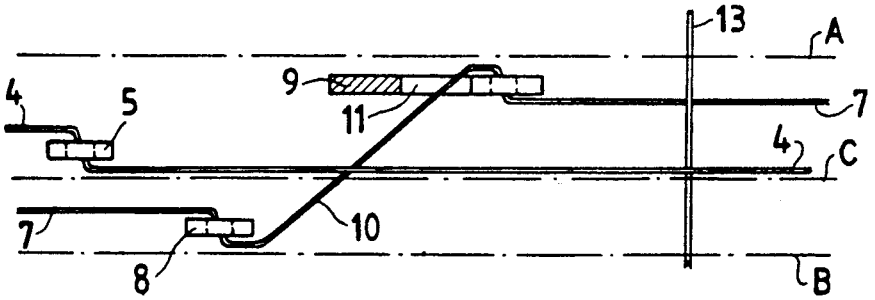

FIG. 5, and, in plan view, also FIG. 6, show a first step of a first example of practical embodiment of the process according to the present invention in order to cross two warp threads, i.e., a crossing-thread 4 and a stationary-thread 7, with each other.

The cross-thread 4 is, threaded through the hole of a first heald 5, in the top position of a shed 6, while the stationary-thread 7 is in the opposite position, threaded first through the hole of a second heald 8 and then through the hole of a third heald 9 having a particular shape. In fact, the third heald 9 in this particular form of practical embodiment of the present invention, is provided with an arm 9*a* extending from it and along a short distance parallel to it, so as to define a gap 11. A length, or a portion 10, of the stationary thread 7, running between the threading holes of the two healds 8 and 9 which move it, constitutes a line segment. The line segment 10 can be inclined, so as to cross a weaving plane, indicated by the character "C" in FIG. 5, alternatively on the one half-plane and on the opposite half-plane of the same weaving plane, which is defined as the plane on which the fabric is formed, and is subdivided into the half-planes by the stationary-thread 7.

The inclined line segment 10 is such as to cause the crossing-thread 4 to alternatively shift to both sides of the stationary-thread 7.

In the FIG. 5 taken into consideration herein, the inclination of the length, or line segment 10, of the stationary-thread 7 is such as to move the crossing-thread 4 to run, during its subsequent movement in order to come to the opposite position of the shed 6, along its surface, until the crossing-thread 4 enters the gap provided on the third heald 9. On examining FIG. 6, one will observe that the line segment constituted by the length 10 of stationary thread 7 connects two planes, or two sets of planes, indicated in chain line in A and B, perpendicular to the weaving plane C and laying parallel to the stationary-thread, on both sides of this latter.

A beating reed 12, only shown in this FIG. 5 in order to simplify the following figures, beats a first weft insertion 13, to bring it to rest against the weft insertions already inserted in the fabric, before the healds are moved in order to invert the positions of the threads in the shed 6.

Figure 7:
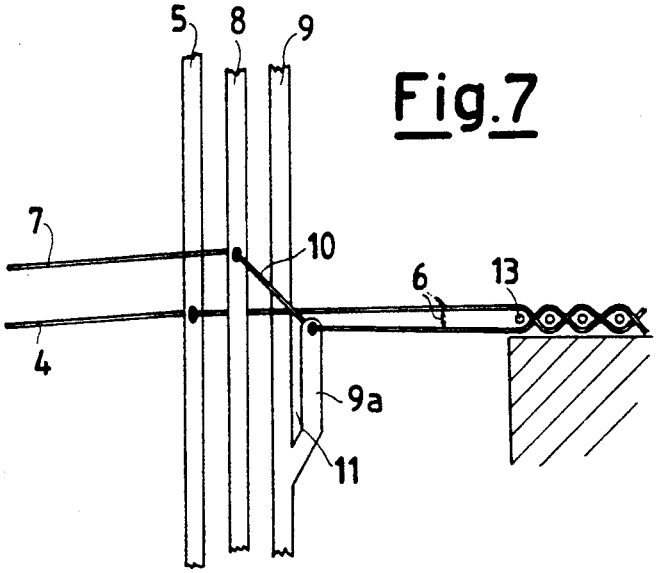
Figure 9:
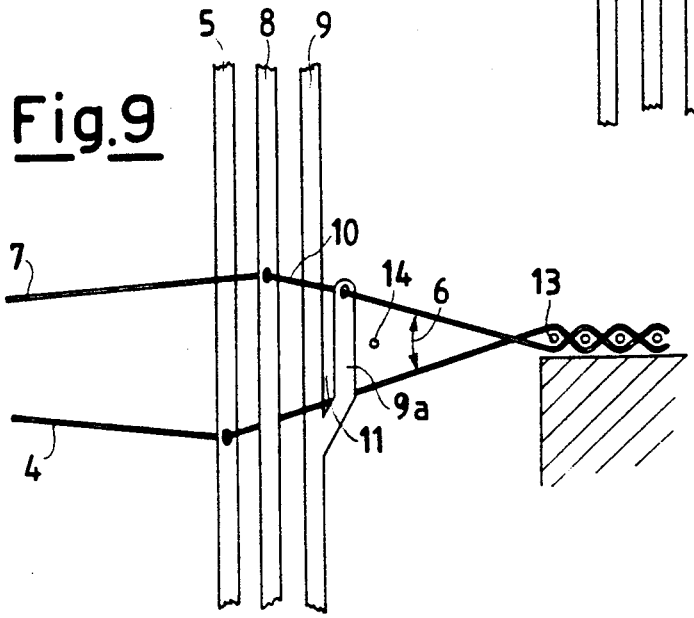
Figure 8:
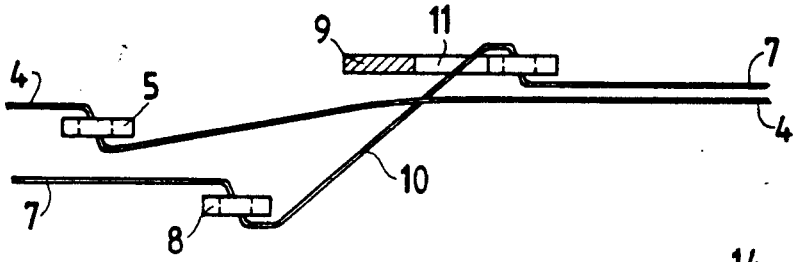
Figure 10:
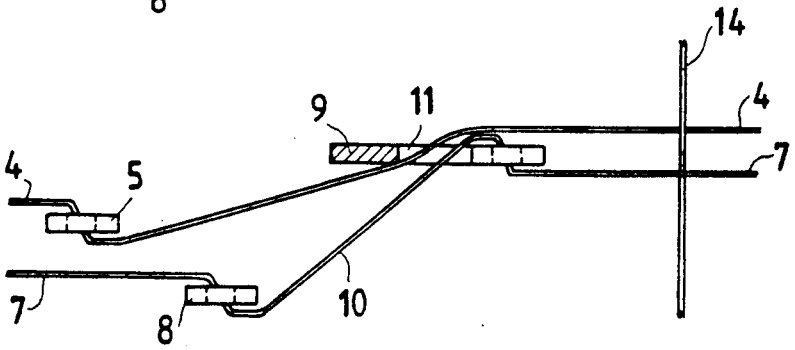

FIG. 7, and its relevant plan view shown in FIG. 8, show an intermediante time point, in which the shed 6 is practically closed, between the steps of the preceding FIGS. 5 and 6 and the step depicted in following FIGS. 9 and 10.

The comprehension of these figures, whose importance is particularly due to the fact that they evidence how the crossing-thread 4, having begun its sliding along the surface of the inclined portion 10 of the stationary-thread 7, has already laterally moved in the direction of the slope of the inclined length 10. In fact, the crossing-thread 4 is shifted from the trajectory perpendicular to the weaving plane, which it would otherways run along as a consequence of the only effect of the movement of the heald 5 through which it runs and thanks to the particular shape of the special heald 9 and to its position relatively to the position of the above heald 5.

In the step shown in FIGS. 9 and 10, the crossing-thread 4 has ended its sliding, and has entered the gap 11 of the third heald 9, thus getting shifted and coming to lay on a plane A perpendicular to the weaving plane C and parallel to the stationary-thread 7, but on the opposite side relatively to the side on which it was during the initial step shown in FIGS. 5 and 6, on one plane from the set of planes B.

Figure 12:
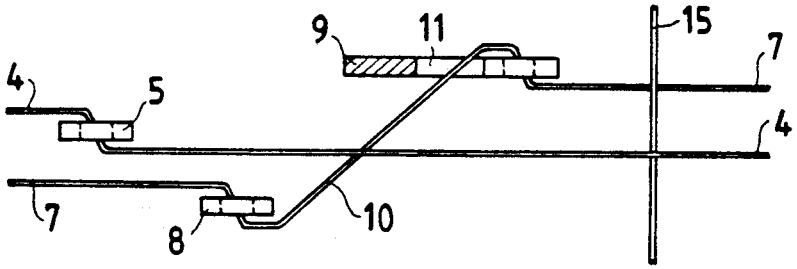
Figure 11:
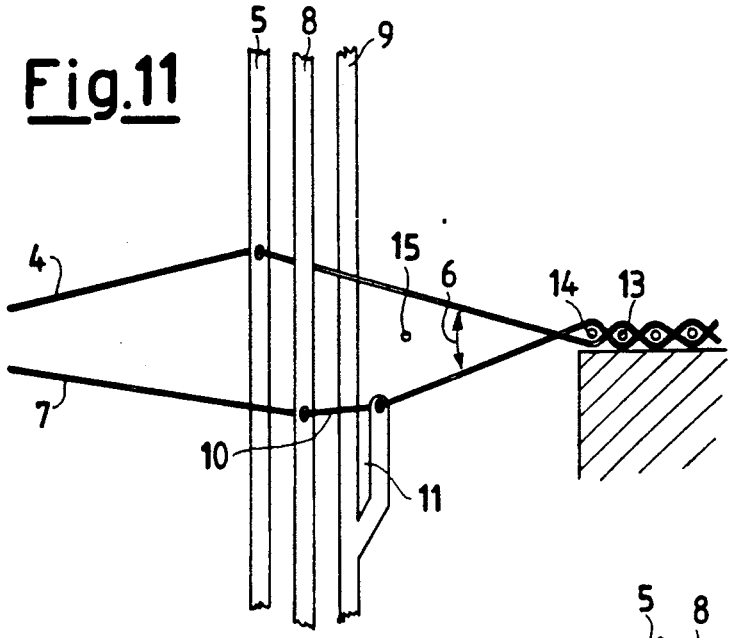

The only difference between the just discussed step and the step of FIGS. 11 and 12 is the inversion of position in the shed 6, of the crossing-thread 4, displaced by the heald 5, and of the stationary-thread 7, displaced by the healds 8 and 9, with the result that the length of stationary-thread 10 is placed now in a substantial horizontal position in the bottom side of the shed. One should furthermore observe, above all, the coming out of the crossing-thread 4 from the gap 11, with the crossing-thread 4 being consequently returned back onto the vertical plane perpendicular to the weaving plane which is on the same side of the stationary-thread 7 as of the heald 5 which controls it.

Figure 14:
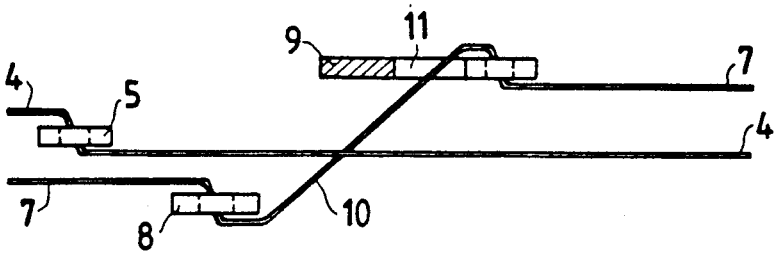
Figure 16:
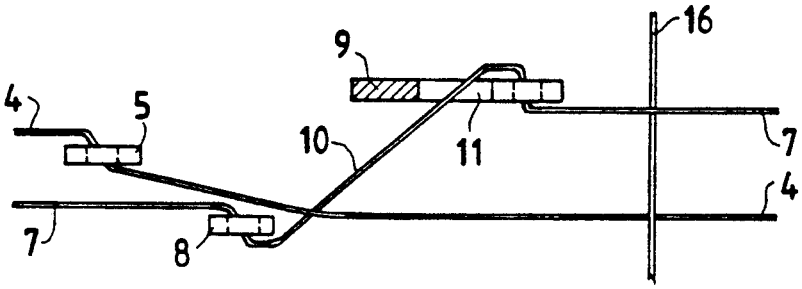
Figure 13:
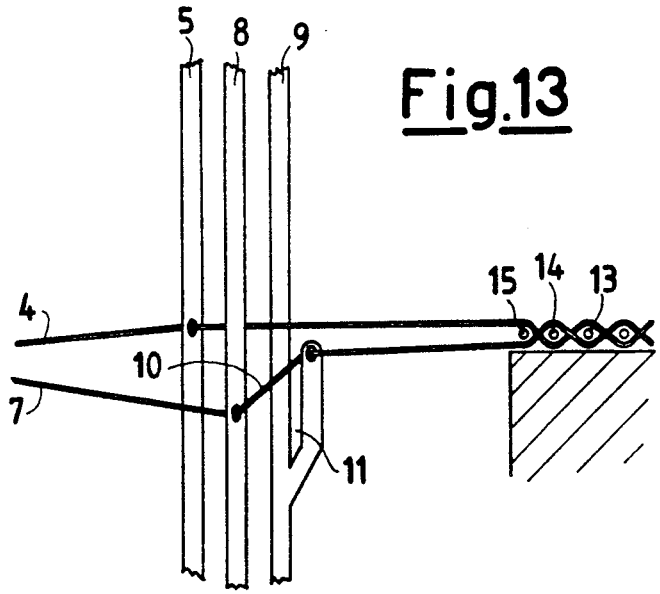
Figure 15:
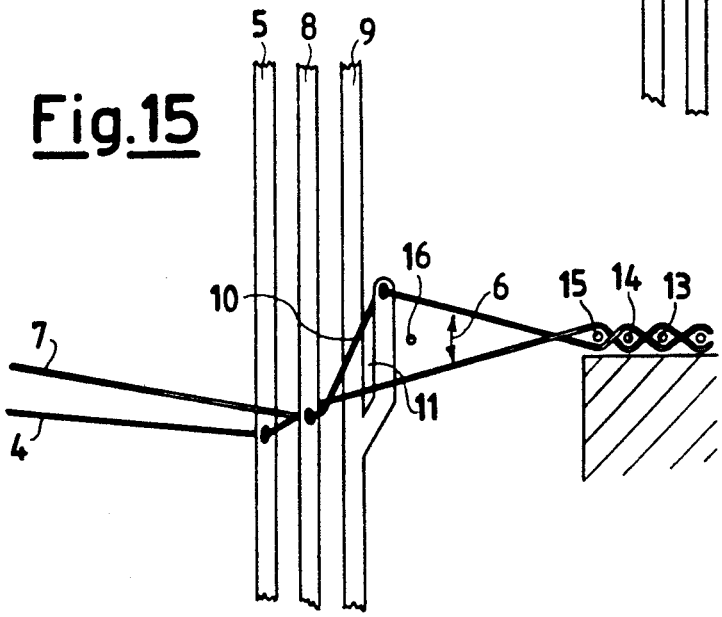

Also FIGS. 13 and 14 show an intermediate point of time between the step shown by FIGS. 11 and 12, and the step shown by the subsequent FIGS. 15 and 16. One may easily observe here that the crossing-thread 4 is not deviated now, during its movement of shifting towards the opposite side of the shed 6, by the inclined length 10 of the stationary-thread 4. Such a stationary-thread length 10, with the herein shown inclination, enables hence said crossing-thread 4 to simply completely move on a plane perpendicular to the weaving plane C, without any motion components parallel to the weaving plane, but it does not constitute, in this step of this particular form of practical embodiment of the present invention, a sliding line which may cause the crossing-thread to shift parallelly to the weaving plane.

In fact, only during the end portion of such a movement, i.e., during the step as shown in FIGS. 15 and 16, the crossing-thread 4 comes to rest on the inclined length of the stationary-thread 7 and, by sliding along the surface thereof, gets slightly shifted from its trajectory perpendicular to the weaving plane. This is just a case which the present Applicant wished to show, which is due to a particular dimensioning of the strokes of the healds and to the positioning of the same healds, but such a sliding is at all immaterial as regards the practicing of the herein proposed method according to the present invention.

In FIG. 17 a schematic view can be seen of a portion of a gauze fabric, or of a leno or cross weaving texture, manufactured according to the exemplifying form of practical embodiment of the method proposed by the present invention, as disclosed by the FIGS. from 5 to 16.

FIGS. from 18 to 22 and from 18*a* to 22*a* show another possible exemplifying form of possible practical embodiment of the method proposed according to the present invention, in which for same components same reference numerals are used, and in which two warp threads 17 and 18 are provided, which are destined to act as stationary-threads. In this case, the line segment which can be inclined in order to cause the crossing-thread 4 to slide during its movement of shifting to the one, or to the other one, of the sides of the two stationary-threads 17 and 18, is actually constituted by two lengths 21 and 22 of the same two different stationary threads 17 and 18 so as to form, from a strictly geometrical point of view, not one only, but two different line segments.

Figure 18:
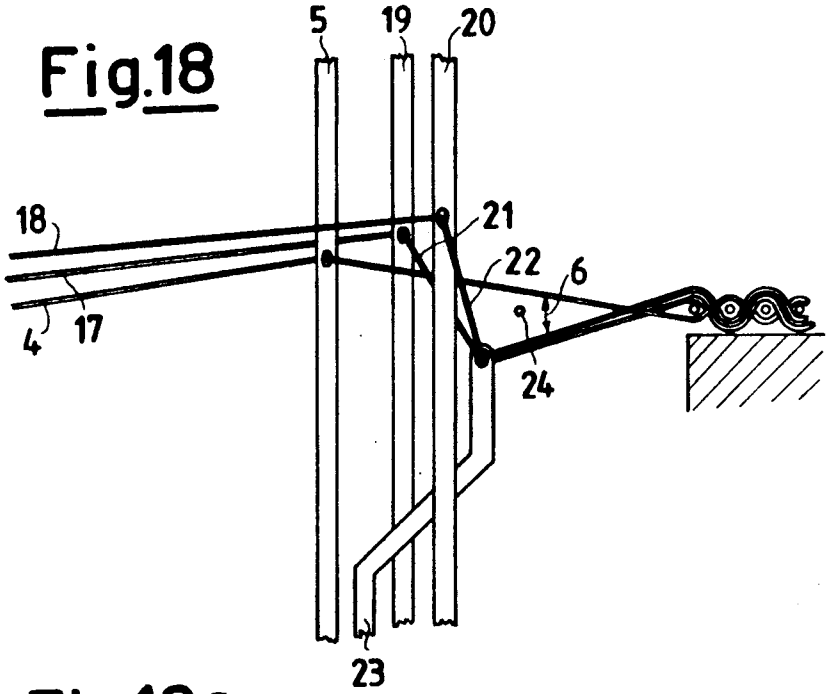
Figure 18A:
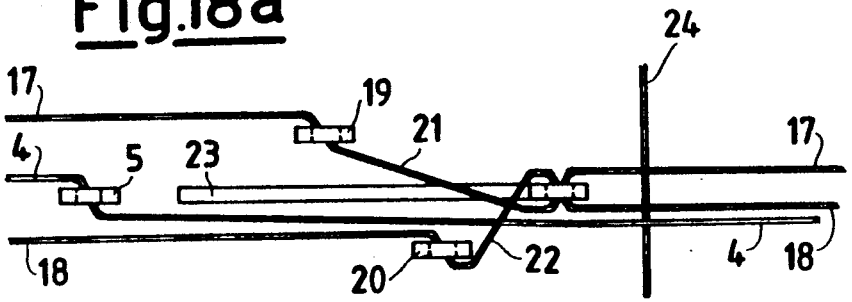

In FIG. 18, and in the plan view of FIG. 18*a*, the crossing-thread 4, moved by the corresponding heald 5, is in the top position of the shed 6 and before going to the fabric being formed, runs above a first weft insertion 24, through a "V" region formed by two lengths (i.e. first and second line segments) 21 and 22 of the stationary threads 17 and respectively 18. These stationary threads 17 and 18, which are in the bottom side of the shed 6, moved by the respective healds 19 and 20, come together into the hole of a further heald 23, which has a special shape, and is destined to move them inside the shed 6.

The relative position of each one of the lifted healds 19 and 20 relatively to the further, lowered, heald 23 determines the inclinations of both lengths 21 and 22 of the stationary-threads which, in their turn, cause the shifting of the crossing-thread 4 to the one side and to the other side of the further heald 23, and therefore of the stationaty-threads 17 and 18 coming together into the hole thereof, and exiting it, such as to define the two half-planes into which the weaving plane C is subdivided. The movement of the further heald 23 is decided on the basis of the desired textile interlacement between weft insertions 24 and following, and the stationary-threads 17 and 18.

Figure 19:
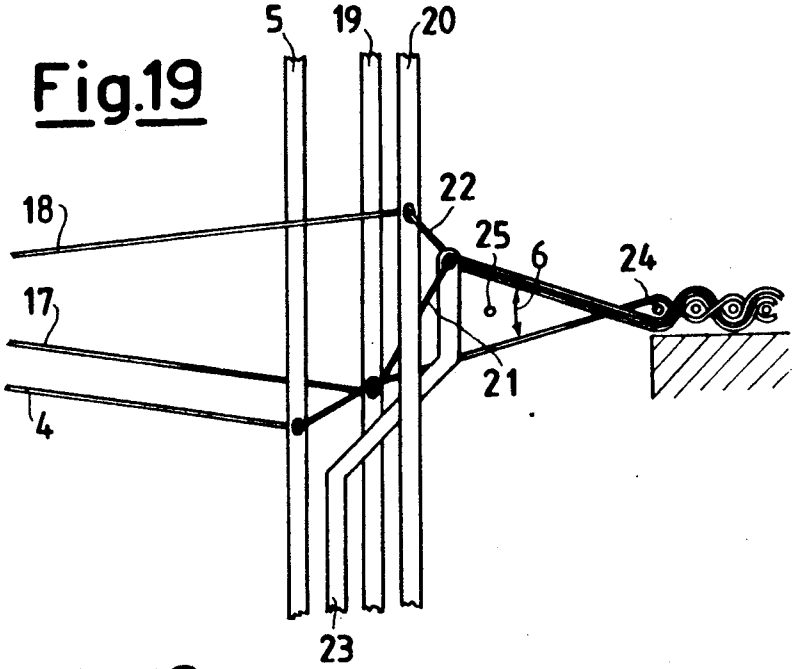
Figure 19A:
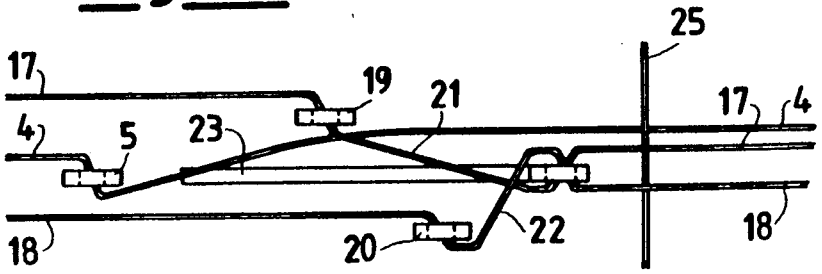

On examining FIGS. 19 and 19*a*, one can observe that the lowering of the heald 19 caused the length 21 of stationary-thread 17 to get inclined in such a way that the crossing-thread 4, by sliding along the surface of this inclined thread portion during its movement of shifting towards the opposite position in the shed 6, has moved, relatively to the further heald 23, and therefore relatively to both of the stationary-threads running through its hole, to the side of the heald 19 which can be assimilated to a plane A as disclosed in the preceding example, and perpendicular to the weaving plane C. In other terms, the crossing-thread 4 has moved to the same side from which the stationary-thread 17 comes, and it was initially caused to slide towards that side by the opposite inclination of the inclined length 22 of the stationary-thread 18.

Figure 20:
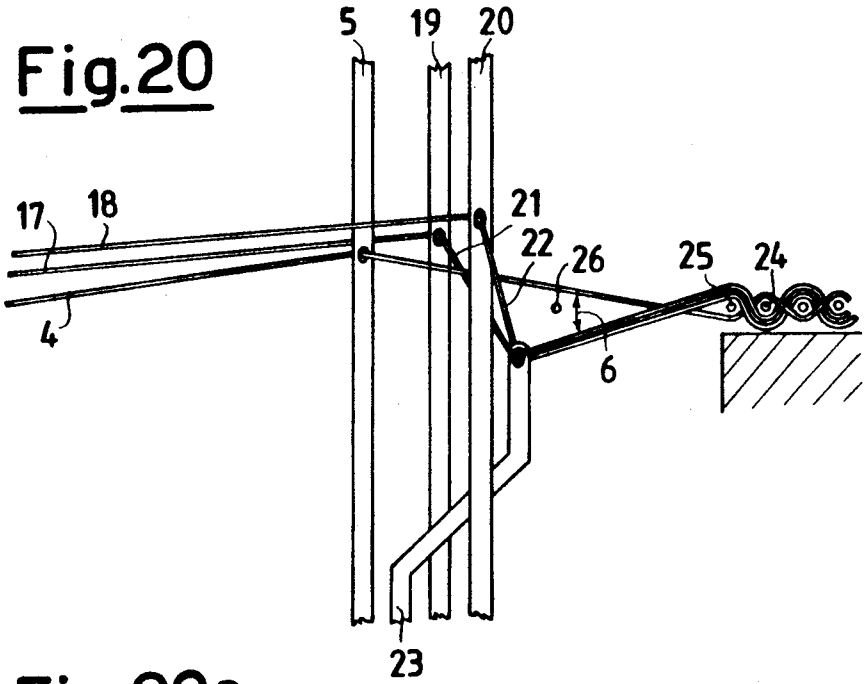
Figure 20A:
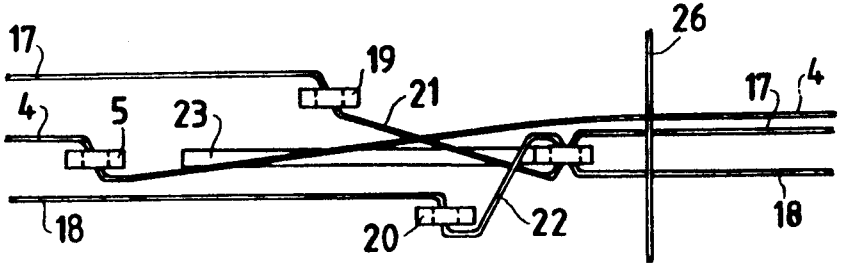

After a further weft insertion 25 is carried out, a situation similar to the situation of FIG. 18 arises again. This situation is shown in FIGS. 20 and 20*a* and is easily understood from the examination of the Figures. The only change is that the crossing-thread 4 has moved from a plane B to a plane A.

Figure 21:
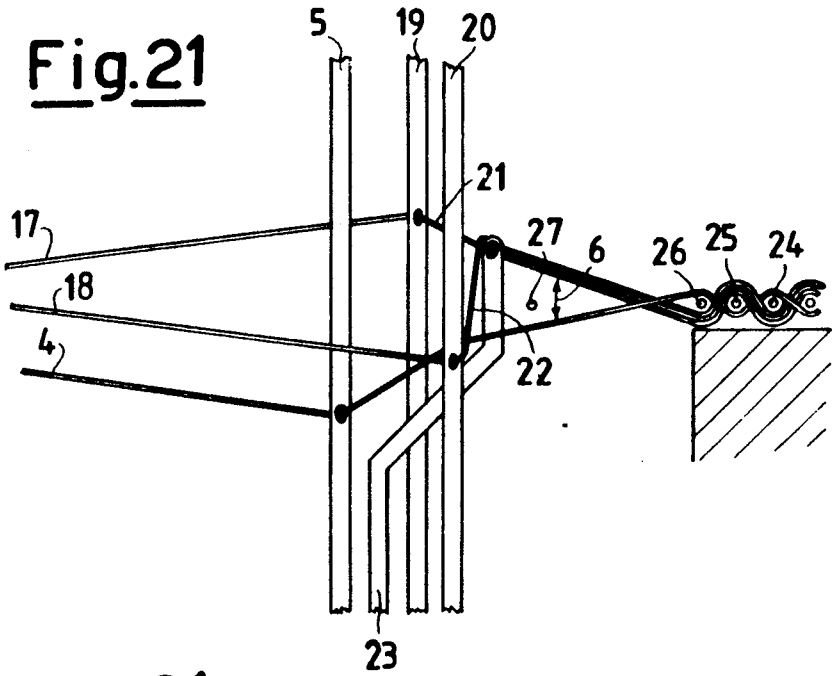
Figure 21A:
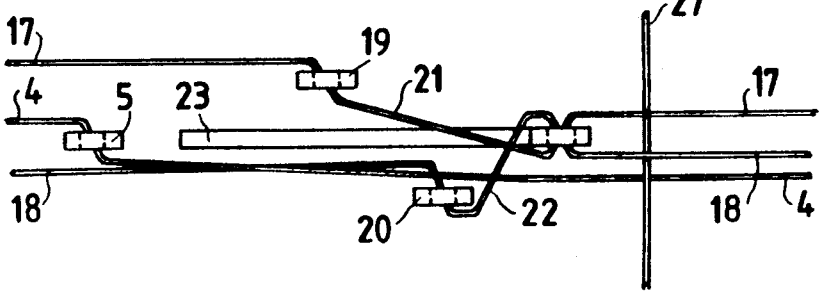

In the step shown in FIGS. 21 and 21*a*, one can see how a situation opposite to the situation of FIG. 19 moves the crossing-thread 4 to a plane B on the opposite side relatively to the stationary-threads 17 and 18. In fact, the heald 20 has been lowered, and the heald 19 remains in its upper position: the crossing-thread 4 is thus obliged to slide along the surfaces of both of the inclined lengths of the stationary-threads 21 and 22, sliding relatively to the heald 23 and relatively to the two stationary-threads which run through the hole of the heald, on the same side as of the heald 20.

In FIG. 22, a schematic representation is shown of a textile interlacing or of a portion of a fabric manufactured according to the form of practical embodiment of the method of the present invention as just proposed and disclosed in FIGS. from 18 to 21.

In FIGS. from 23 to 27, in which to the same elements the same reference numerals have been assigned, a further form of a practical embodiment of the method according to the present invention can be seen, as applied to the production of fabrics provided with loops 39 protruding from their surface. In this case, the presence has to be noticed of an element aiming at keeping lifted the loops 39, which, in the herein exemplified form of practical embodiment, is a metal blade 34 fastened to the same weaving plane by means of a support 32. The metal blade remains inserted inside the fabric for a certain length, and the fabric gets disengaged from it during, and thanks to, the fabric's movement of production progressing.

The crossing-thread 4, by getting crossed with the metal blade 34, is obliged to form loop portions, or loops, 39, around it, which loops are of size and shape corresponding to those of the cross-section of the metal blade so that, as the fabric gets disengaged from the metal blade, only the loops remain, which loops precisely protrude outwards from the fabric with a stationary-thread 28 being inside them. More precisely, the element for keeping raised portions of the crossing-thread 4 is positioned in correspondence of at least one portion of the stationary-thread 28, denominated "line segment" and indicated by the reference numeral 31, and under it.

Figure 23:
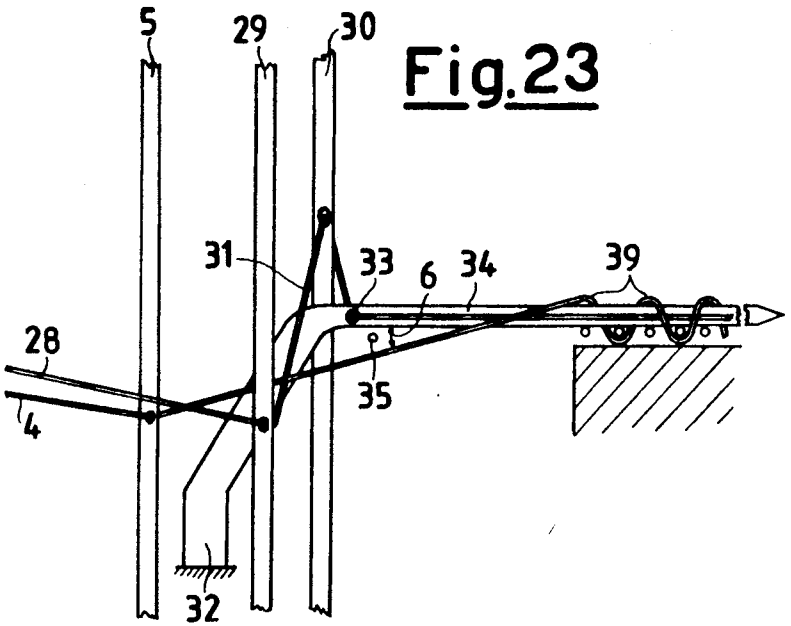
Figure 23A:
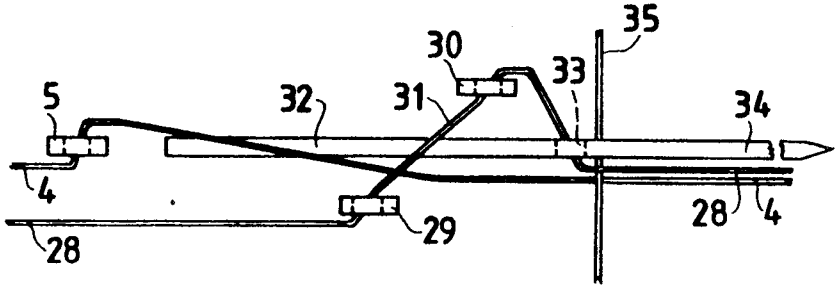

In FIGS. 23 and 23*a*, the crossing-thread 4 is in the bottom position of the shed 6, looking at the figure, and is before the metal blade 34 and the stationary-thread 28 positioned above a weft insertion 35. A portion, or line segment, 31 of the stationary thread 28, thanks to the lowered position of a heald 29 and to the simultaneously lifted position of the heald 30, is inclined towards a plane B on the same side as of the heald 29. The stationary-thread runs through the holes of such healds 29 and 30 before also running through the hole 33 of the metal blade 34 which returns it back to a stable position, parallel to the weaving plane, alongside of the same metal blade.

Figure 24:
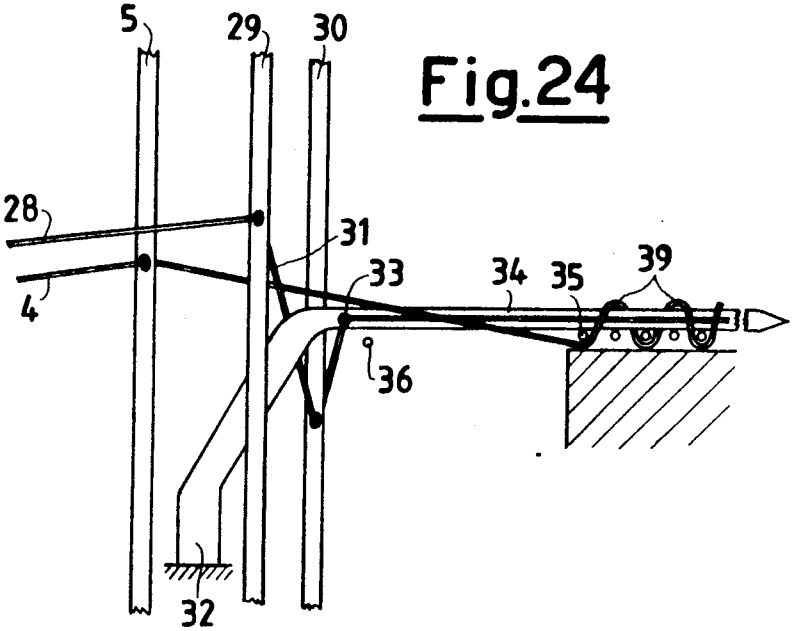
Figure 24A:
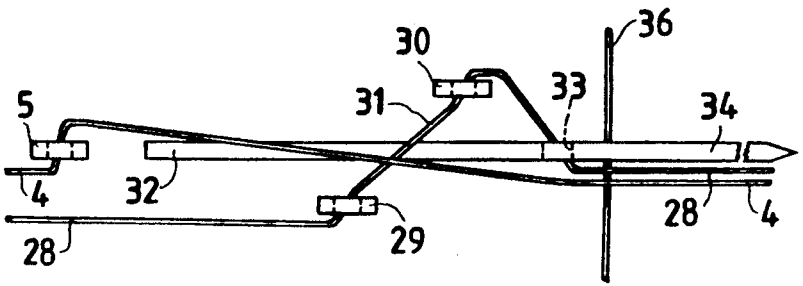

In following FIGS. 24 and 24*a*, the crossing-thread 4 has been brought by the respective heald 5 to the top side of the shed 6, while the two healds 29 and 30 which move the stationary-thread 28 have inverted their position. The result is that the lentgh 31 of the stationary thread 28 comprised between these two healds has been inclined now towards the opposite side, i.e., towards the plane A, ready to offer to the crossing-thread 4 a sliding line which makes it slide, during its subsequent movement downwards, to the opposite side of the stationary-thread 28 and of the metal blade 34 alongside of each other; and behind them, looking at the figure. In fact, in FIGS. 25 and 25*a*, after the weft insertion being carried out, the crossing-thread 4 will be found in its expected position, after precisely passing over the stationary-thread and the metal blade 34, thus forming a further loop 39.

Figure 26:
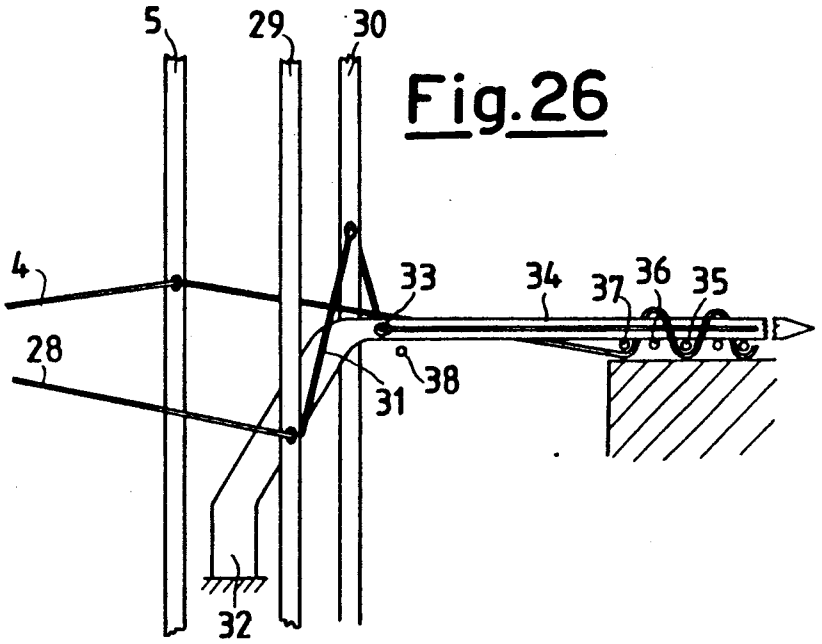
Figure 26A:
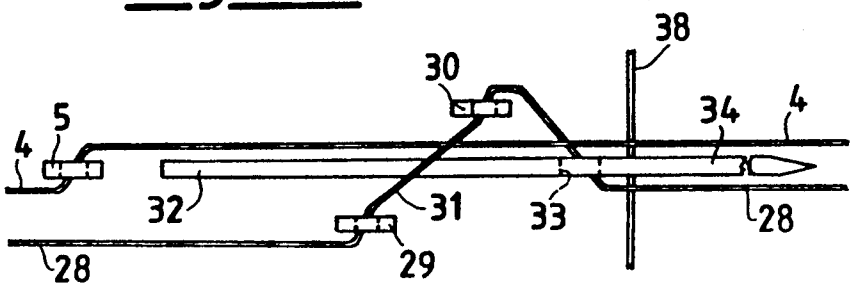
Figure 25:
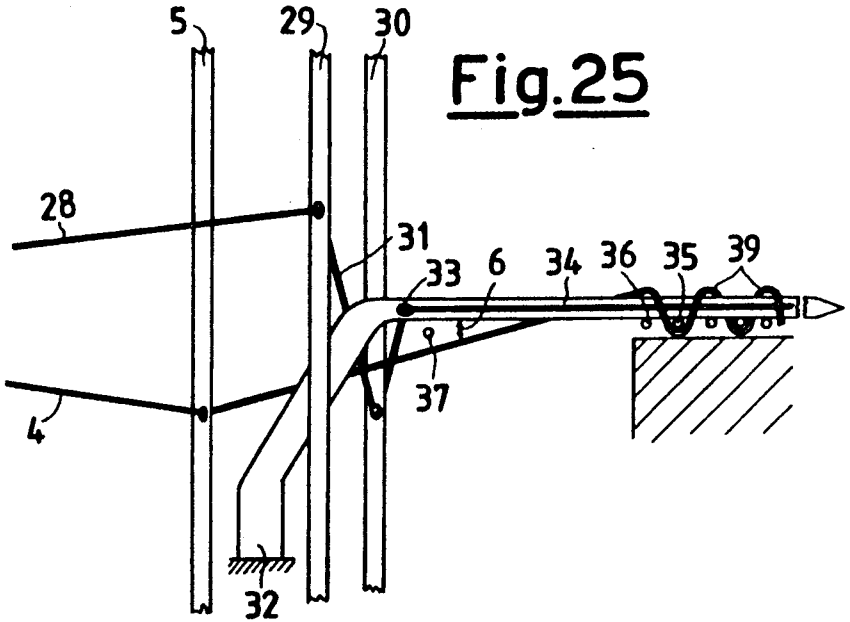
Figure 25A:
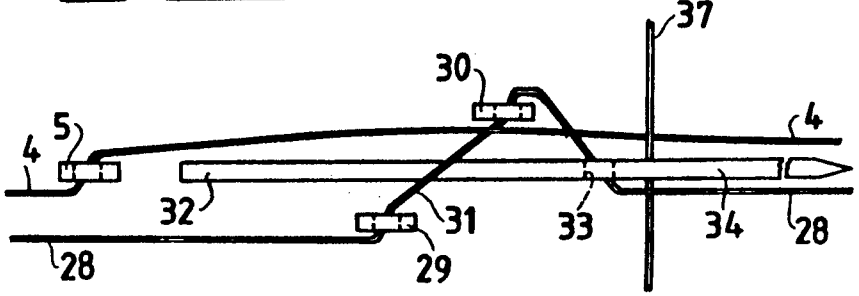
Figure 29:
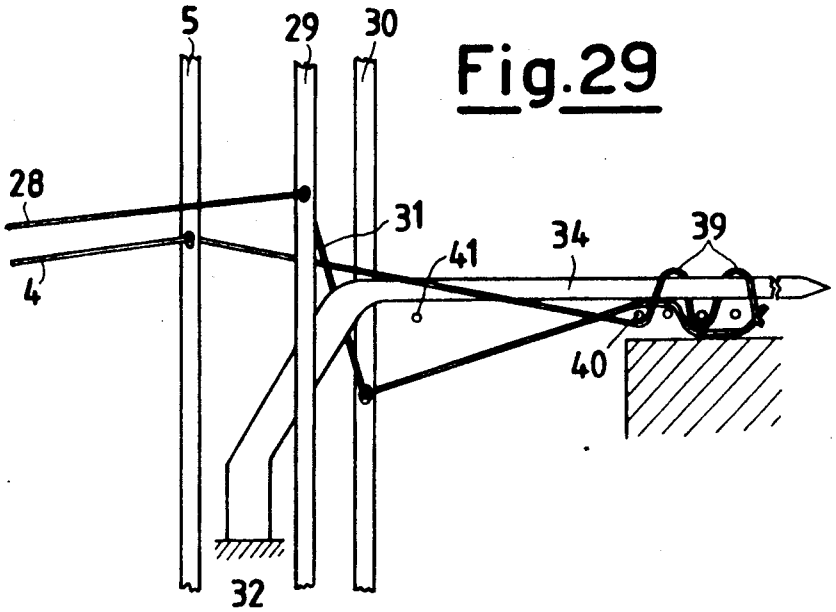
Figure 29A:
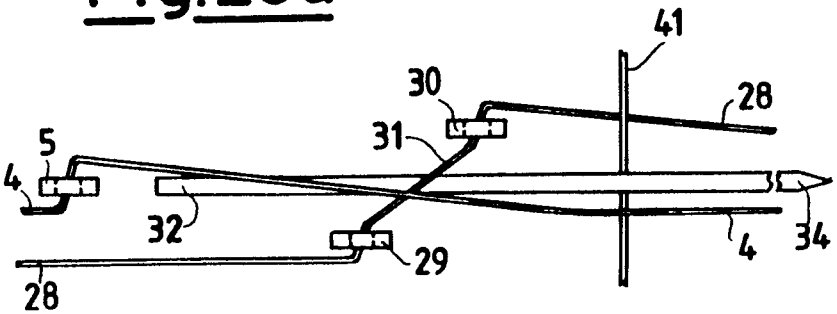
Figure 28:
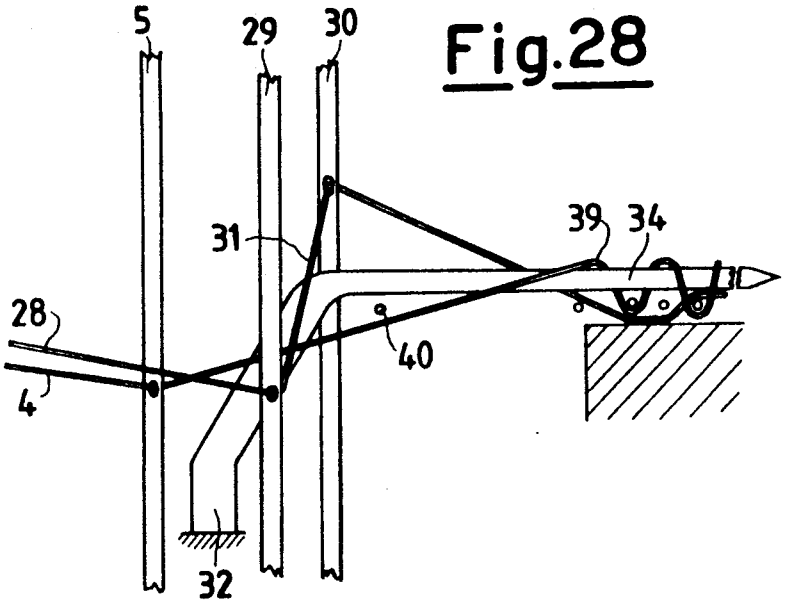
Figure 28A:
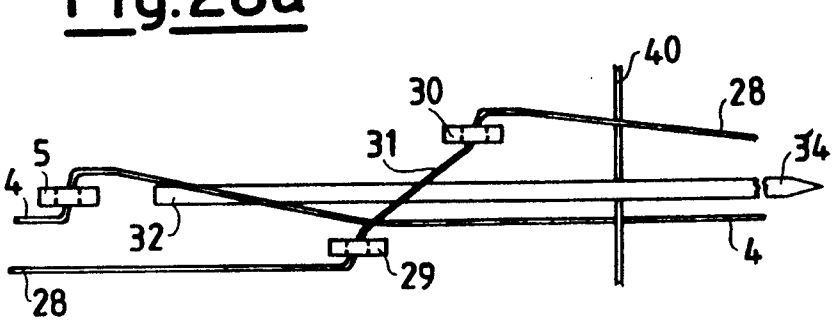
Figure 31:
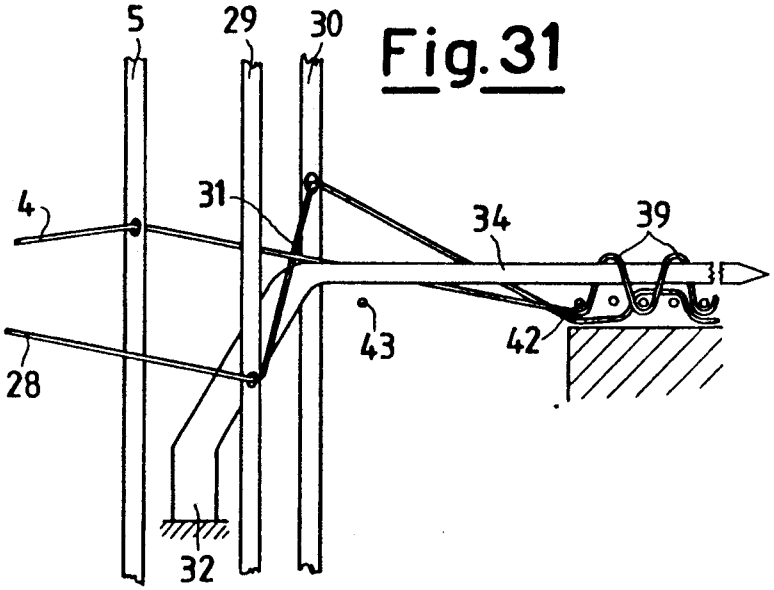
Figure 31A:
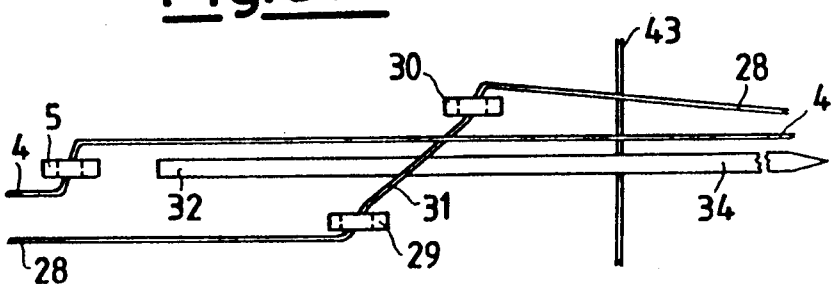
Figure 30:
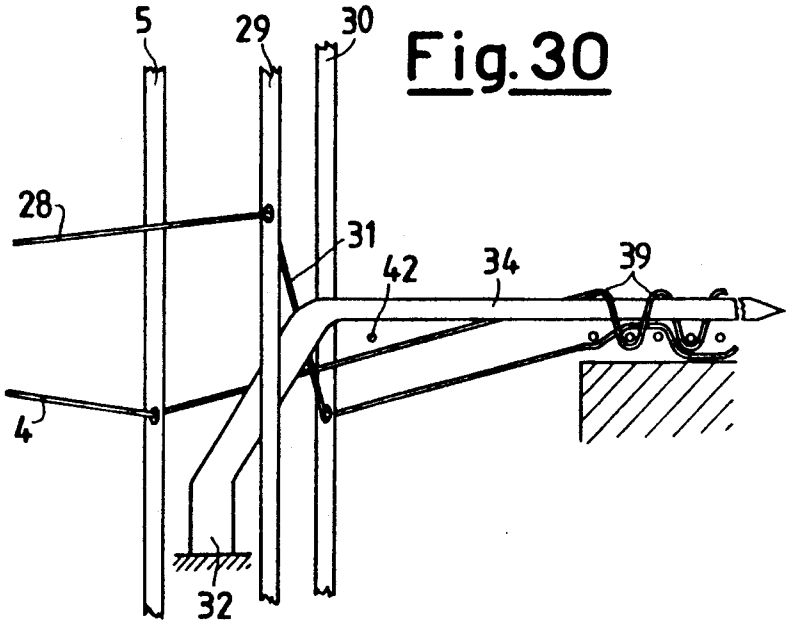
Figure 30A:
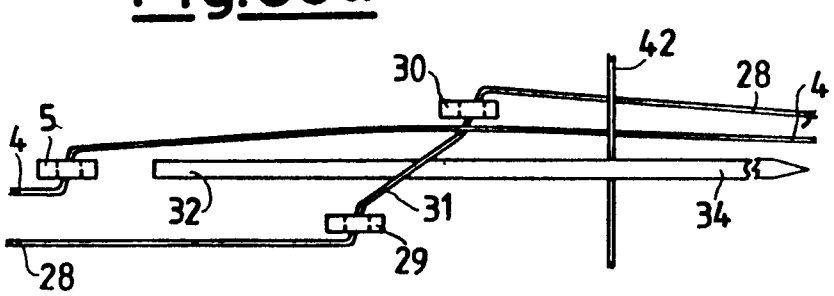

After a weft insertion 37, in FIGS. 26 and 26*a*, the crossing-thread 4 returns back to its top position, with the healds 29 and 30 which control the stationary-thread 24 simultaneously inverting again their position, so that the inclination of the length 31 will be now in the suitable direction for a further crossing to be caused to occur between the stationary thread 28 and the crossing-thread 4.

From FIG. 27, which shows a schematic representation of a portion of fabric, adjacent to the weaving point, obtained according to the just discussed particular form of practical embodiment of the method of the present invention, one may also observe how at a certain point the fabric gets disengaged from the metal blade, and only the stationary-thread 28 remains inside the loops.

The further form of practical embodiment of the same method as proposed by FIGS. from 28 to 32 demonstrates the flexibility of the method according to the instant invention.

In fact, by simply getting rid of the last passage of the warp thread 38 through the hole 33, which in the preceding case was provided in the metal blade 34, in this case a fabric can be obtained which is still provided with loops 39 protruding from its surface, but without any stationary-threads inside it, in that such a warp thread 28 has become now an auxiliary thread which, after being used for constituting the inclined length 31 along which the crossing-thread 4 slides, gets tied with the weft insertions externally to the gauze interlacement, therefore without getting crossed with the crossing-thread 4.

Providing again the whole explanation already given for the preceding set of figures is not necessary here; however, it is worth dwelling for a while on FIG. 32, from which one may detect that, from the view point of the strictly precise textile terminology, it would be inappropriate to speak here of "English-crossing fabric" in order to define the obtained fabric, in that, once that this latter has got disengaged from the metal blades 34, no stationary elements are any longer present (i.e., neither a stationary-thread, nor a metal blade crossing with the crossing-thread). The weaving method called "gauze weaving" has in fact been used here for the only purpose of creating the loops 39 thanks to the crossing of the crossing-thread 4 which constitutes them, with the metal blade 34 replacing, at least for a certain length inside the fabric, the stationary-thread.

It should be understood however that the herein proposed method does not pose any limitations, not only to the accomplishable interlacement and fabric structure, as well as to the system for obtaining the inclined line segments on which the crossing-thread slides, but not even to any further obtainable features.

Such a method is essentially characterized by the use of one or more line segments which can be alternatively inclined towards the one side, or towards the other side, of the at least one stationary-thread provided, and constituted by lengths of warp threads on whose surface the crossing-thread is caused to slide, thus being alternatively shifted, owing to the effect of such different inclinations, to the one side and to the other side of the same at least one stationary-thread: only thanks to such one or more inclined sliding length(s) the possibility is given of accomplishing the gauze interlacement in all of its possible and imaginable variants, due to the function performed by these lengths, of causing the crossing-thread, according to presettable sequential cycles, to slide to opposite regions of the shed, and to opposite half-weaving plane relatively to the stationary-thread.

The same at least one inclined sliding length can be accomplished, and/or thought of, in several ways and positions. The essential characteristic thereof is that it should perform the hereinabove illustrated functions in order that the leno or cross weaving texture can be obtained by means of the sliding which said inclined sliding length will cause the crossing-thread to undergo, in order that the crossing-thread is brought to cross with the stationary-thread.

Finally, the stationary-thread can be accompanied by other warp threads, with each of said threads performing its independent movements in its own shed and perpendicularly to the weaving plane: the crossing-thread will perform its movements getting crossed with this set of warp threads.

I claim:

1. A method of producing a leno or cross weaving texture alternating with successive weft insertions, a cross warp thread being crossed with at least one stationary warp thread alternately from one side to an opposite side of the stationary warp thread, said method comprising the steps of:

(a) providing a line segment connecting, at an upstream side of a beating reed, two planes perpendicular to the weaving plane, one of said two planes lying on one side of said stationary warp thread, the other of said two planes lying on the opposite side of said stationary warp thread, said line segment being formed by a longitudinal portion of said stationary warp thread;

(b) inclining said line segment so as to cause said line segment to cross the weaving plane alternately from an upper side of said one plane to an under side of said opposite plane, and from an under side of said one plane to an upper side of said opposite plane; and (c) moving said cross warp thread in a perpendicular direction relative to the weaving plane and above said line segment being inclined so that said cross warp thread during its movement is caused to slide along said inclined line segment toward said one plane or toward said opposite plane, so as to cross said stationary warp thread, thus producing the leno or cross weaving texture.

2. Method according to claim 1, wherein a plurality of loops protruding from the textile interlacement are formed by positioning, in correspondence of at least a portion of said line segment, under it and extending downstream up to reach the interior of the formed leno or cross weaving texture, an element performing the task of keeping lifted on a plane substantially perpendicular to the weaving plane, portions of said cross warp thread which are crossed with said element and with weft insertions and which at a later time, when the fabric gets disengaged from the element which keeps lifted said portions of said crossing-thread, due to the movement of production progressing of said fabric, said loops remain protruding from the fabric, and are only crossed with said weft insertions.

3. Method according to claim 2, wherein with said portions of said cross warp thread at least one warp thread is crossed.

4. Method according to claim 3, wherein said at least one warp thread crossed with said portions of said cross warp thread is the stationary warp thread.

5. A method of producing a leno or cross weaving texture in which alternately with successive weft insertions, a cross warp thread is crossed with a pair of stationary warp threads alternately from one side to the opposite side of the pair of stationary warp threads, said method comprising the steps of:

(a) spreading said pair of stationary warp threads upstream of a beating reed so as to cause them to provide first and second line segments, respectively, said first line segment leading to one plane lying on one side of said pair of stationary warp threads and perpendicular to the weaving plane, said second line segment leading to the other plane lying on the opposite side of said pair of stationary warp thread and perpendicular to the weaving plane;

(b) inclining said first and second line segments alternately so as to alternately cause said first line segment to cross the weaving plane obliquely from an under side to an upper side of said one plane, and cause said second line segment to cross the weaving plane obliquely from an under side to an upper side of said second plane; and (c) moving said cross warp thread in a perpendicular direction relative to the weaving plane and above said first and second line segments being inclined so that said cross warp thread during its movement is caused to slide alternately along said inclined first line segment toward said one plane, and along said inclined second line segment toward said other plane, so as to cross said pair of stationary warp threads, thus producing the leno or cross weaving texture.

* * * * *